US005252082A

United States Patent [19]

Hsieh et al.

[11] Patent Number: 5,252,082

[45] Date of Patent: Oct. 12, 1993

[54] SAFETY PLUG

[76] Inventors: Kuang N. Hsieh, No. 1058, Chien Cheng Rd.; Wen B. Hsieh, No. 1056, Chien Cheng Rd., both of Taichung, Taiwan

[21] Appl. No.: 964,498

[22] Filed: Oct. 21, 1992

Related U.S. Application Data

[63] Continuation-in-part of Ser. No. 893,240, Jun. 3, 1992, abandoned.

[51] Int. Cl.[5] ..... H01R 13/44

[52] U.S. Cl. ..... 439/141; 439/136

[58] Field of Search ..... 439/135, 136, 140, 141, 439/149

[56] References Cited

U.S. PATENT DOCUMENTS 3,754,205 8/1973 Lenkey ..... 439/141

4,340,267 7/1982 Nukaga ..... 439/141

5,030,119 7/1991 Lowe ..... 439/141

FOREIGN PATENT DOCUMENTS 0660645 5/1938 Fed. Rep. of Germany ..... 439/140

*Primary Examiner*—Larry I. Schwartz

*Assistant Examiner*—Khiem Nguyen

*Attorney, Agent, or Firm*—Kolisch Hartwell Dickinson McCormack & Heuser

[57] ABSTRACT

A plug includes two prongs extended outward from a body, a casing slidably engaged on the body of the plug and having a hardness greater than that of said body, a spring biasing the casing away from the body, and a housing engaged on the casing. A sleeve is embedded in the body for preventing the spring from electrically connecting with the prongs. The prongs are shielded by the casing during plugging operation of the plug.

3 Claims, 2 Drawing Sheets

SAFETY PLUG

This is a continuation-in-part of Ser. No. 07/893,240, filed Jun. 3, 1992, now abandoned.

BACKGROUND OF THE INVENTION

1. Field of the Invention

The present invention relates to a plug, and more particularly to a safety plug.

2. Description of the Prior Art

Typical plugs include at least two prongs extended outward from the body for plugging into a socket and the like, however, part of the prongs are exposed if the plugs are not fully plugged into place. This is dangerous if children inadvertently electrically couple the prongs by metal materials or if children touch the prongs simultaneously.

In order to solve the problems, people develop several kinds of safety plugs for protecting the prongs of the plug. One of the safety plugs is disclosed in U.S. Pat. No. 3,754,205 to Lenkey, filed on May 19, 1971, in Lenkey, the prongs are not stably retained in place and apt to become loose and will be easily disengaged from the plug; in addition, a tubular integral spring socket is formed in the center portion of the plug, however, in view of manufacturing process, a shaft or a rod should be engaged in the spring socket after the plug is molded, the spring socket will hold the rod solidly such that the disengagement of the plug from the rod is very difficult and has become a serious problem. Furthermore, when using the safety plug, the detents formed integral with the cover are exposed in the area where the fingers of the user hold the plug, such that the movement of the detents and thus of the cover will be interfered or be interrupted.

Another type of safety plug is disclosed in U.S. Pat. No. 5,030,119 to Lowe filed Sep. 27, 1989, in Lowe, the forward housing member and the protective cover are both made of resilient materials and contacted with each other, the protective cover will be held tight within the housing member when the user grips the housing member of the plug, such that the movement of the protective cover will also be interfered or be interrupted. In addition, the prongs have only a small part held in the respective blade holding arms such that the blade holding arms can not stably and solidly hold the prongs in place. Furthermore, the conductors embedded in the plug may have penetrating strands or burr which may be extended into the hole during molding processes, such that the penetrating strands or burr may contact the spring received in the hole, and such that the prongs will be electrically contacted with each other by the spring and such that shortage may happen.

The present invention has arisen to mitigate and/or obviate the afore-described disadvantages of the conventional safety plugs.

SUMMARY OF THE INVENTION

The primary objective of the present invention is to provide a safety plug in which the prongs are shielded and will not be exposed when the plug is not fully engaged into the socket.

Another objective of the present invention is to provide a safety plug in which the prongs are stably held in place.

Still another objective of the present invention is to provide a safety plug in which a sleeve member is disposed in the center portion of the plug during molding processes, the sleeve member will not solidly hold the mold piece such that the plug can be easily disengaged from the mold.

In accordance with one aspect of the invention, there is provided a plug comprising a body including a front portion having at least two prongs extended outward therefrom and solidly engaged therein, a hole formed in the body, a sleeve engaged in the hole of the body, a spring received in the sleeve, a casing slidably engaged on the body of the plug and including a pin element extended inwards thereof for engagement with the spring, the casing being biased away from the body by the spring, and a housing engaged on the casing and coupled to the body, the housing including an opening formed therein for slidably engaging with the casing and arranged such that the casing is extendible outward of the housing via the opening, and a stop means for preventing the casing from disengaging from the housing, whereby, the prongs are shielded by the casing during plugging operation of the prongs, and the sleeve prevents the spring from electrically connecting with the prongs.

Further objectives and advantages of the present invention will become apparent from a careful reading of the detailed description provided hereinbelow, with appropriate reference to the accompanying drawings.

DETAILED DESCRIPTION OF THE PREFERRED EMBODIMENT

Figure 1:
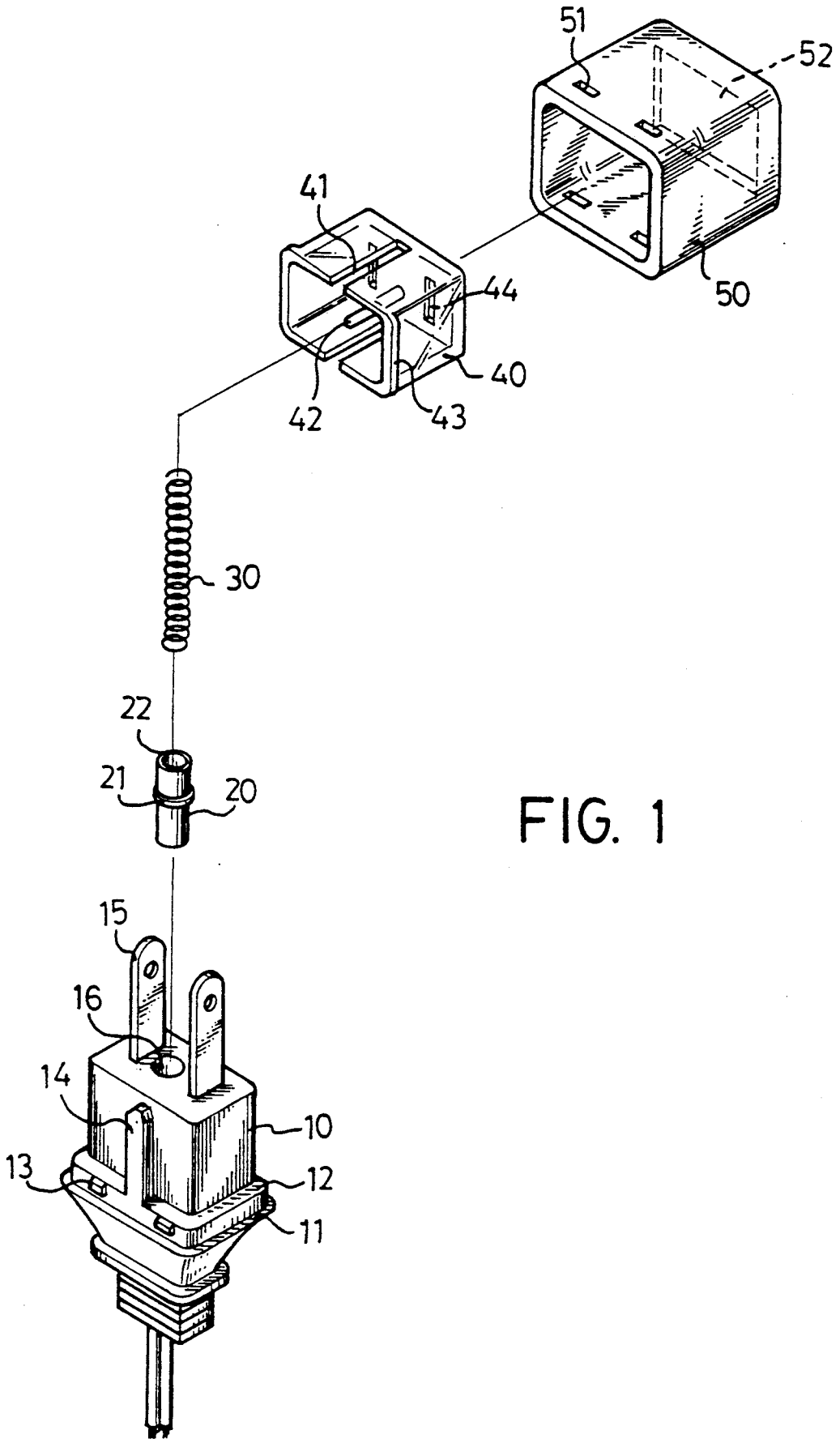
FIG. 1 is an exploded view of a safety plug in accordance with the present invention.
Figure 2:
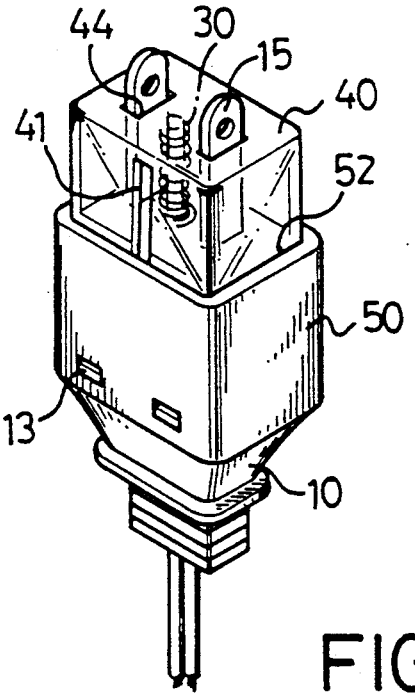
FIG. 2 is a perspective view of the safety plug.
Figure 3:
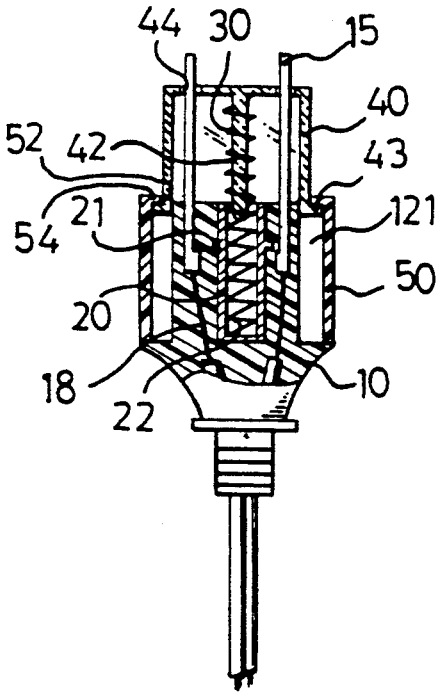
FIGS. 3 and 4 are cross sectional views illustrating the operations of the plug.

Referring to the drawings, and initially to FIGS. 1 to 3, a safety plug in accordance with the present invention comprises generally a body 10 including at least two prongs 15 extended outward from the front portion thereof and having the lower portion solidly retained in the plug, a first shoulder 11 and a second shoulder 12 formed in the lower portion of the body 10, four protrusions 13 formed between the shoulders 11, 12, two ribs 14 oppositely formed on the outer portion of the body 10, and a hole 16 formed in the center portion of the body 10 and formed between the prongs 15. It is to be noted that the prongs 15 are solidly engaged in the body 10 and will not become loose and will not be easily disengaged from the body of the plug.

A sleeve 20 for receiving a spring 30 includes an annular rib 21 formed in the outer peripheral portion thereof and is engaged in the hole 16 of the body 10 and is preferably made of acrylonitrile butadiene styrene material which has a hardness greater than that of the materials forming the body 10 of the plug, such that the sleeve 20 will not tightly hold the mold piece (not shown) engaged in the sleeve after molding processes, and such that the plug can be easily disengaged from the mold. In addition, the conductors 18 connected to the prongs 15 may include burr or penetrating strands which can not penetrate through the sleeve 20 such that the conductors 18 are prevented from electrically contacting with the spring 30 received in the sleeve 20.

A casing 40 is substantially parallelepiped having an open end engaged onto the body 10 and engageable with the second shoulder 12 and having two apertures 44 formed in the opposite end for engagement with the prongs 15, a pin element 42 is formed integral with the casing 40 and extended inwards of the casing 40 for engagement in the spring 30 and insertable into the sleeve 20, the casing 40 is biased away from the body 10 by the spring 30, best shown in FIG. 3. Two slots 41 are oppositely formed in the casing 40 for slidably engaging with the ribs 14 of the body 10 respectively, the ribs 14 forms the guiding means for guiding the sliding movement between the casing 40 and the body 10. A flange 43 is formed in the peripheral portion of the open end of the casing 40.

A housing 50 engages on the casing 40 and engages with the first shoulder 11 and includes four orifices 51 for engagement with the protrusions 13 of the body 10 of the plug in order to couple the housing 50 to the body 10. The housing 50 includes an opening 52 formed therein for sliding engagement with the casing 40 and arranged such that a flange 54 is formed around the opening 52, as best shown in FIG. 3, the flange 43 of the casing 40 is engageable with the flange 54 of the housing 50 so that the casing 40 is prevented from disengaging from the housing 50.

It is to be noted that, the ribs 14 form the guiding means for guiding the sliding movement between the casing 40 and the body 10. In addition, the ribs 14 also form a reinforcing means for the body 10; it is preferable that the ribs 14 have a thickness slightly larger than that of the casing 40, such that, when the housing 50 is gripped by the user, the housing 50 is caused to contact with the ribs 14 and will not contact with the casing 40, and such that the movement of the casing 40 will not be interfered or be interrupted, the casing 40 can thus move swiftly and smoothly.

Figure 4:
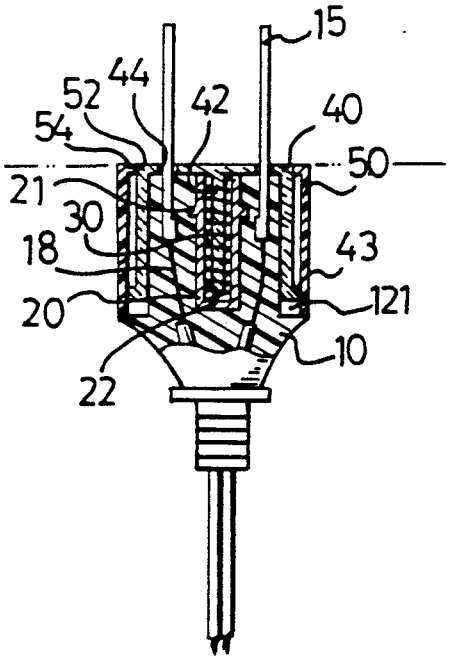

In operation, as shown in FIG. 3, the casing 40 is biased to cover most part of the prongs 15; however, as shown in FIG. 4, during the plugging operations of the plug into a socket, the casing 40 is biased to contact with the socket 30, such that the prongs 15 are shielded by the casing 40 and will not be exposed during the plugging operations of the safety plug.

Accordingly, the safety plug includes a casing 40 for covering the prongs 15 such that the prongs 15 will not be exposed during the insertion of the plug into the socket. In addition, there is no additional tool required to assembly the spring 30 and the casing 40 and the housing 50 onto the body 10 of the plug.

Although this invention has been described with a certain degree of particularity, it is to be understood that the present disclosure has been made by way of example only and that numerous changes in the detailed construction and the combination and arrangement of parts may be resorted to without departing from the spirit and scope of the invention as hereinafter claimed.

I claim:

1. A plug comprising a body including a front portion having at least two prongs extended outward therefrom and solidly engaged therein, a hole formed in said body, a sleeve engaged in said hole of said body and having a hardness greater than that of said body, a spring received in said sleeve, a casing slidably engaged on said body of said plug and including a pin element extended inwards thereof for engagement with said spring, said casing being biased away from said body by said spring, and a housing engaged on said casing and coupled to said body, said housing including an opening formed therein for slidably engaging with said casing and arranged such that said casing is extendible outward of said housing via said opening, and a stop means for preventing said casing from disengaging from said housing, said body including at least one rib formed on an outer portion thereof, said casing including at least one slot for slidably engaging with said rib of said body, said rib having a thickness slightly greater than that of said casing, whereby, said prongs are shielded by said casing during plugging operation of said prongs, and said sleeve prevents said spring from electrically connecting with said prongs, said casing is guided to slide relative to said body by the engagement between the rib and the slot and said housing is preventing from contacting said casing when said housing is gripped by a user.

2. A plug comprising a body including a front portion having at least two prongs extended outward therefrom and solidly engaged therein, a hole formed in said body, a sleeve engaged in said hole of said body and having a hardness greater than that of said body, a spring received in said sleeve, a casing slidably engaged on said body of said plug and including a pin element extended inwards thereof for engagement with said spring, said casing being biased away from said body by said spring, said casing including a first flange formed on an outer peripheral portion thereof and engageable with said body, and a housing engaged on said casing and coupled to said body, said housing including an opening formed therein for slidably engaging with said casing and arranged such that said casing is extendible outward of said housing via said opening, a second flange formed around said opening of said housing for engagement with said first flange of said casing in order to prevent said casing from disengaging from said housing, said body including at least one rib formed on an outer portion thereof, said casing including at least one slot for slidably engaging with said rib of said body, said rib having a thickness slightly greater than that of said casing, whereby, said prongs are shielded by said casing during plugging operation of said prongs, and said sleeve prevents said spring from electrically connecting with said prongs, said casing is guided to slide relative to said body by the engagement between the rib and the slot and said housing is preventing from contacting said casing when said housing is gripped by a user.

3. A lug comprising a body including a front portion having at least two prongs extended outward therefrom and solidly engaged therein, a hole formed in said front portion of said body, a first shoulder and a second shoulder formed in a rear portion of said body, at least one protrusion formed on said body and formed between said first shoulder and said second shoulder, a sleeve engaged in said hole of said body and having a hardness greater than that of said body, a spring received in said sleeve, a casing slidably engaged on said body of said plug and engageable with said second shoulder of said body and including a pin element extended inwards thereof for engagement with said spring, said casing being biased away from said body by said spring, and a housing engaged on said casing and engaged with said first shoulder of said body and including at least one orifice formed therein for engagement with said protrusion of said body in order to couple said housing to said body, said housing including an opening formed therein for slidably engaging with said casing and arranged such that said casing is extendible outward of said housing via said opening, and a stop means for preventing said casing from disengaging from said housing, said body including at least one rib formed on an outer portion thereof, said casing including at least one slot for slidably engaging with said rib of said body, said rib having a thickness slightly greater than that of said casing, whereby, said prongs are shielded by said casing during plugging operation of said prongs, and said sleeve prevents said spring from electrically connecting with said prongs, said casing is guided to slide relative to said body by the engagement between the rib and the slot and said housing is preventing from contacting said casing when said housing is gripped by a user.

* * * * *